US008507162B2

(12) United States Patent
Maruyama et al.

(10) Patent No.: US 8,507,162 B2
(45) Date of Patent: Aug. 13, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Akihiro Maruyama, Mishima (JP); Kunihiko Sekido, Numazu (JP); Hideaki Nagasaka, Suntou-gun (JP); Shinji Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 13/279,713

(22) Filed: Oct. 24, 2011

(65) Prior Publication Data

US 2012/0107735 A1 May 3, 2012

(30) Foreign Application Priority Data

Oct. 28, 2010 (JP) ..... 2010-242462

(51) Int. Cl.
*G03G 5/047* (2006.01)

(52) U.S. Cl.
USPC ..... 430/60; 430/59.1; 430/64; 430/65; 399/159

(58) Field of Classification Search
USPC ..... 430/59.1, 60, 64, 65; 399/159
See application file for complete search history.

(56) References Cited

U.S. PATENT DOCUMENTS

| | | | | |
|---|---|---|---|---|
| 4,450,219 | A * | 5/1984 | Horie et al. | 430/58.4 |
| 5,126,222 | A | 6/1992 | Iuchi | |
| 5,863,688 | A | 1/1999 | Watanabe | |

FOREIGN PATENT DOCUMENTS

| | | |
|---|---|---|
| JP | 9-151157 | 6/1997 |
| JP | 2005-292821 | 10/2005 |

* cited by examiner

*Primary Examiner* — Peter Vajda
(74) *Attorney, Agent, or Firm* — Canon U.S.A., Inc., IP Division

(57) ABSTRACT

An electrophotographic photosensitive member comprises a conductive support, an intermediate layer provided on the conductive support, and a photosensitive layer provided on the intermediate layer, in which at least one of the intermediate layer and the photosensitive layer comprises a compound represented by the following formula (1):

(1)

7 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

In the electrophotographic field, there have recently been advances in improvement in image quality typified by colorization. Colorization increases the number of halftone images and solid images, which are required to have better image quality. For example, in an electrophotographic apparatus using reversal development, when image formation in which a portion irradiated with light is responsible for a halftone image in a subsequent rotation is performed in one image, a phenomenon (positive ghost phenomenon) in which the image density of only the portion irradiated with light is increased is liable to occur.

Examples of an electrophotographic photosensitive member include an electrophotographic photosensitive member having a structure in which a charge-generating layer containing a charge-generating substance (organic photoconductive substance) and a hole-transporting layer containing a hole-transporting substance are provided on a conductive support; and an electrophotographic photosensitive member having a structure in which a photosensitive layer (photosensitive layer having a single-layer structure) containing a charge-generating substance and a hole-transporting substance is provided on a conductive support.

In the case where the photosensitive layer is just provided on the conductive support, hole injection can occur from the conductive support to the photosensitive layer when a voltage is applied to the electrophotographic photosensitive member. The hole injection from the conductive support to the photosensitive layer causes black-spot-like image defects (hereinafter, referred to as "black spots"), significantly reducing the image quality. To overcome the foregoing problems, a method is employed in which an electrically blocking intermediate layer is provided between the photosensitive layer and the conductive support.

However, at an excessively high electrical resistance of the intermediate layer, electrons generated in the charge-generating layer are accumulated in the photosensitive layer to cause a ghost phenomenon. Thus, the electrical resistance of the intermediate layer needs to be reduced to some extent. It is necessary to achieve a good balance between the suppression of the formation of a ghost image and the suppression of black spots.

To suppress the accumulation of electrons in the photosensitive layer and produce an electrophotographic photosensitive member that suppresses the formation of a ghost image, a method is employed in which surface-treated metal oxide particles are incorporated into the intermediate layer. Japanese Patent Laid-Open No. 3-013957 discloses that metal oxide particles surface-treated with an organic titanium compound are incorporated into an intermediate layer. Japanese Patent Laid-Open No. 2005-292821 discloses that metal oxide particles surface-treated with a sulfur atom-containing reactive organic compound are incorporated into an intermediate layer. Japanese Patent Laid-Open No. 9-151157 discloses that the use of an electron-transporting substance allows electrons in a photosensitive layer to flow to a conductive support.

However, even if the surface-treated metal oxide particles or the electron-transporting substance is used, a high-level balance between the suppression of the formation of a ghost image and the suppression of black spots is not achieved.

SUMMARY OF THE INVENTION

Aspects of the present invention provide an electrophotographic photosensitive member including a conductive support, an intermediate layer provided on the conductive support, and a photosensitive layer provided on the intermediate layer, the electrophotographic photosensitive member being capable of achieving a high-level balance between the suppression of the formation of a ghost image and the suppression of black spots. Furthermore, aspects of the present invention provide a process cartridge and an electrophotographic apparatus which include the electrophotographic photosensitive member.

One disclosed aspect of the present invention provides an electrophotographic photosensitive member comprising a conductive support, an intermediate layer provided on the conductive support, and a photosensitive layer provided on the intermediate layer and comprising a charge-generating substance and a hole-transporting substance, in which at least one of the intermediate layer and the photosensitive layer comprises a compound represented by the following formula (1):

(1)

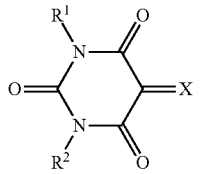

wherein, in the formula (1), $R^1$ and $R^2$ each independently represent a hydrogen atom or a methyl group, and X represents a group having a structure represented by the following formula (X1) or (X2):

(X1)

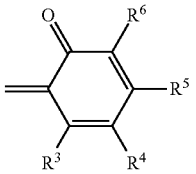

wherein, in the formula (X1), $R^3$ to $R^6$ each independently represent a hydrogen atom, an alkyl group having 1 to 4 carbon atoms, a halogen atom, or a methoxy group, or an atomic group for forming an aromatic ring together with $R^n$ and $R^{n+1}$, n represents an integer from 3 to 5, and the aromatic ring is unsubstituted or substituted with a halogen atom, an alkyl group having 1 to 4 carbon atoms, a halogenated alkyl group having 1 to 4 carbon atoms, or a nitro group, (X2)

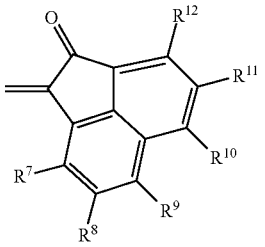

wherein, in the formula (X2), $R^7$ to $R^{12}$ each independently represent a hydrogen atom, an alkyl group having 1 to 4 carbon atoms, a halogen atom, a methoxy group, a nitro group, or a halogenated alkyl group having 1 to 4 carbon atoms, or atomic group for forming an aromatic ring together with $R^n$ and $R^{n+1}$, and n represents an integer from 7 to 11.

According to another aspect of the present invention, a process cartridge detachably attachable to a main body of an electrophotographic apparatus wherein the process cartridge integrally supports the electrophotographic photosensitive member and at least one device selected from the group consisting of a charging device, a developing device, a transferring device, and a cleaning device.

According to another aspect of the present invention, an electrophotographic apparatus includes the foregoing electrophotographic photosensitive member, a charging device, an exposure device, a developing device, and a transferring device.

According to aspects of the present invention, the incorporation of the compound having the structure represented by the formula (1) into at least one of the intermediate layer and the photosensitive layer of the electrophotographic photosensitive member results in the electrophotographic photosensitive member that achieves a high-level balance between the suppression of the formation of a ghost image and the suppression of black spots. Aspects of the present invention also provide the process cartridge and the electrophotographic apparatus which include the electrophotographic photosensitive member.

Further features of the present invention will become apparent from the following description of exemplary embodiments with reference to the attached drawings.

DESCRIPTION OF THE EMBODIMENTS

An electrophotographic photosensitive member according to aspects of the present invention has a layer structure including a conductive support, an intermediate layer provided on the conductive support, and a photosensitive layer provided on the intermediate layer.

In aspects of the present invention, a conductive layer may be provided between the conductive support and the intermediate layer, the conductive layer including conductive fine particles, in order to cover flaws and protrusions of the conductive support and suppress interference fringes (moiré).

Typical examples of the photosensitive layer include a photosensitive layer having a single-layer structure in which a hole-transporting substance and a charge-generating substance are contained in one layer; and a photosensitive layer having a laminated structure (functionally separated structure) including a charge-generating layer that contains a charge-generating substance and a hole-transporting layer that contains a hole-transporting substance. In aspects of the present invention, the photosensitive layer having a laminated structure (functionally separated structure) can be used.

Figure 2:
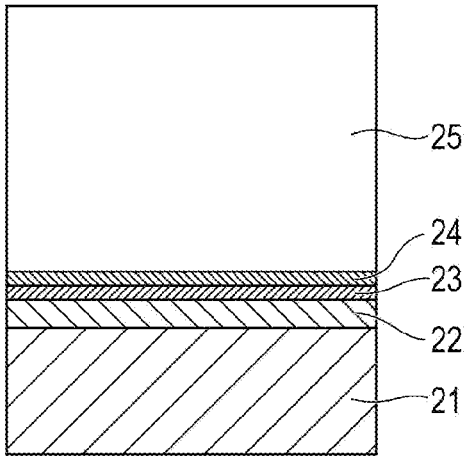
FIG. 2 illustrates the layer structure of an electrophotographic photosensitive member according to aspects of the present invention.

FIG. 2 schematically illustrates an exemplary structure of an electrophotographic photosensitive member according to aspects of the present invention. In the electrophotographic photosensitive member illustrated in FIG. 2, a conductive layer 22, an intermediate layer 23, a charge-generating layer 24, a hole-transporting layer 25 are stacked, in that order, on a conductive support 21. A protective layer may be provided on the hole-transporting layer 25, as needed.

The intermediate layer is provided between the conductive support and the photosensitive layer in order to suppress hole injection from the conductive support to the photosensitive layer. The intermediate layer contains a compound having the capability of transporting electrons and having a structure represented by formula (1), thus making it possible to achieve a high-level balance between the suppression of the formation of a ghost image and the suppression of black spots.

The reason the electrophotographic photosensitive member according to aspects of the present invention achieves the high-level balance between the suppression of the formation of ghost images and the suppression of black spots is speculated as follows.

A ghost phenomenon is probably associated with a field intensity and the amount of charge remaining in the photosensitive layer (charge-generating layer). In a light area with a low surface potential due to exposure of the photosensitive member, the field intensity in the photosensitive layer is reduced to increase the amount of charge remaining in the photosensitive layer (charge-generating layer). When significant effects are provided at the time of next charging, the ghost phenomenon occurs. The black spots are probably caused by hole injection from the side of the conductive support to the photosensitive layer (charge-transporting layer) at a high field intensity.

The compound having a structure represented by the formula (1) according to aspects of the present invention can successfully provide the electron-injection ability and electron-transport ability because a pyrimidinetrione skeletal moiety has the high electron-withdrawing ability and is connected to a conjugated unsaturated cyclic structure by a double bond to further stabilize a charge. Thus, in the case where only the pyrimidinetrione skeletal moiety is present or the pyrimidinetrione skeletal moiety is connected to a conjugated unsaturated cyclic structure not by a double bond but by a single bond, it is speculated that a good balance between the electron-injection ability and the electron-transport ability is not achieved. The compound has a high electron-withdrawing structure and is thus assumed to have a high ionization potential, thereby providing high hole-blocking ability. It is believed that when the compound is incorporated into the photosensitive layer (charge-generating layer), the compound in the photosensitive layer (charge-generating layer) can receive electrons and transport the electrons toward the conductive support to reduce the residual charge even at a low field intensity, which is disadvantageous for charge transfer. It is also believed that when the compound is incorporated into the intermediate layer, the compound receives electrons at the interface between the intermediate layer and the photosensitive layer (charge-generating layer) because of the structure of the compound that readily receives electrons, and transports electrons toward the conductive support to suppress the hole injection from the conductive support. This can be significantly effective in achieving a balance between the suppression of the formation of a ghost image and the suppression of black spots.

In aspects of the present invention, the compound having the structure represented by formula (1) may be contained in one or both of the photosensitive layer and the intermediate layer. The photosensitive layer can have a laminated structure including a charge-generating layer and a hole-transporting layer provided on the charge-generating layer. In this case, the compound having a structure represented by formula (1) is contained in at least one of the intermediate layer and the charge-generating layer.

Compound Having Structure Represented by Formula (1)

The compound having the structure represented by formula (1) according to aspects of the present invention is contained in at least one of the intermediate layer and the photosensitive layer of the electrophotographic photosensitive member:

(1)

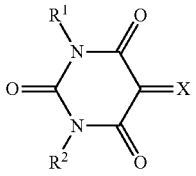

wherein in the formula (1), $R^1$ and $R^2$ each independently represent a hydrogen atom or a methyl group, X represents a group having a structure represented by the following formula (X1) or (X2):

(X1)

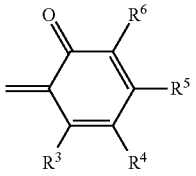

wherein in the formula (X1), $R^3$ to $R^6$ each independently represent a hydrogen atom, an alkyl group having 1 to 4 carbon atoms, a halogen atom, or a methoxy group, or an atomic group for forming an aromatic ring together with $R^n$ and $R^{n+1}$, n represents an integer from 3 to 5, and the aromatic ring is unsubstituted or substituted with a halogen atom, an alkyl group having 1 to 4 carbon atoms, a halogenated alkyl group having 1 to 4 carbon atoms, or a nitro group, and examples of the aromatic ring (aromatic ring structure) formed by joining $R^n$ and $R^{n+1}$, which are selected from $R^3$ to $R^6$, to each other include benzene, naphthalene, phenanthrene, and pyridine, (X2)

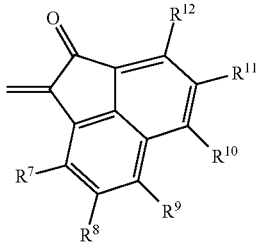

wherein in the formula (X2), $R^7$ to $R^{12}$ each independently represent a hydrogen atom, an alkyl group having 1 to 4 carbon atoms, a halogen atom, a methoxy group, a nitro group, or a halogenated alkyl group having 1 to 4 carbon atoms, or atomic group for forming an aromatic ring together with $R^n$ and $R^{n+1}$, and n represents an integer from 7 to 11.

With respect to $R^7$ to $R^{12}$, an example of the aromatic ring (aromatic ring structure) formed by joining $R^n$ and $R^{n+1}$ to each other is benzene.

The compound represented by formula (1) is a compound represented by formula (1-1) or (1-2):

(1-1)

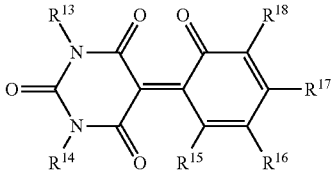

wherein in the formula (1-1), $R^{13}$ and $R^{14}$ each independently represent a hydrogen atom or a methyl group, $R^{15}$ to $R^{18}$ each independently represent a hydrogen atom, an alkyl group having 1 to 4 carbon atoms, a halogen atom, a methoxy group, or an atomic group for forming an aromatic ring together with $R^n$ and $R^{n+1}$, n represents an integer from 15 to 17, and the aromatic ring is unsubstituted or substituted with a halogen atom, an alkyl group having 1 to 4 carbon atoms, a halogenated alkyl group having 1 to 4 carbon atoms, or a nitro group, and examples of the aromatic ring (aromatic ring structure) formed by joining $R^n$ and $R^{n+1}$ to each other include benzene, naphthalene, phenanthrene, and pyridine, (1-2)

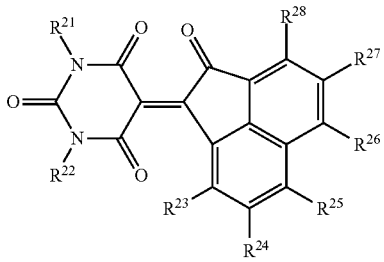

wherein in the formula (1-2), $R^{21}$ and $R^{22}$ each independently represent a hydrogen atom or a methyl group, $R^{23}$ to $R^{28}$ each independently represent a hydrogen atom, an alkyl group having 1 to 4 carbon atoms, a halogen atom, a methoxy group, a nitro group, or a halogenated alkyl group having 1 to 4 carbon atoms, or an atomic group for forming an aromatic ring together with $R^n$ and $R^{n+1}$, and n represents an integer from 23 to 27, and an example of the aromatic ring (aromatic ring structure) formed by joining $R^n$ and $R^{n+1}$ to each other is benzene.

Tables 1 and 2 illustrate exemplified compounds having structures represented by formula (1).

These exemplified compounds may be synthesized in the same way as in a known example (Indian Journal of Chemistry, Section B: Organic Chemistry-Including Medicinal Chemistry, 44B, 6, p. 1252, 2005). The compounds having the structures represented by formula (1) may be prepared by allowing various pyrimidinetrione derivatives to react with various dione derivatives. Examples of the pyrimidinetrione derivatives include barbituric acid (2,4,6(1H,3H,5H)-pyrimidinetrione), 1-methyl-2,4,6(1H,3H,5H)-pyrimidinetrione, and 1,3-dimethyl-2,4,6(1H,3H,5H)-pyrimidinetrione. Examples of the dione derivatives include 9,10-phenanthrenequinone, pyrene-4,5-dione, 4-nitro-9,10-phenanthrenedione, 2-nitrophenanthrenequinone, 11,12-dihydrochrysene-11,12-dione, 4,5,9,10-pyrenetetralone, 1-isopropyl-7-methyl-9,10-phenanthrenequinone, 4,5-dinitro-9,10-phenanthrenequinone, dibenzo[A,H]anthracene-5,6-dione, acenaphthenequinone, 3-methylacenaphthenequinone, aceanthrenequinone, 5,6-dinitro-acenaphthylene-1,2-dione, 1,10-phenanthroline-5,6-dione, 3,5-di-tert-butyl-o-benzoquinone, 3,6-di-tert-butylbenzo-1,2-quinone, 3,4,5,6-tetrachloro-1,2-benzoquinone, and 3,4,5,6-tetrabromo-1,2-benzoquinone.

TABLE 1

| No. | Exemplified compound |
|---|---|
| E-1 | 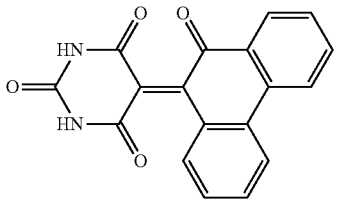 |
| E-2 | 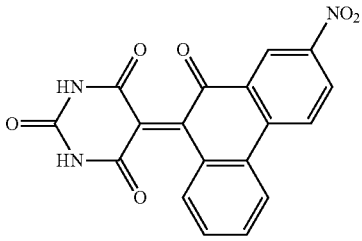 |
| E-3 | 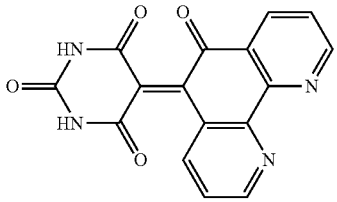 |

TABLE 1-continued

| No. | Exemplified compound |
|---|---|
| E-4 | 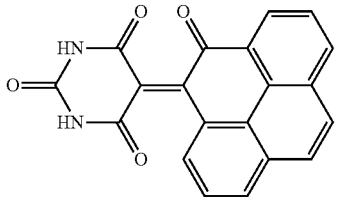 |
| E-5 | 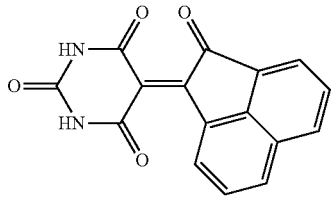 |
| E-6 | 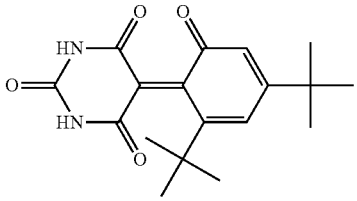 |
| E-7 | 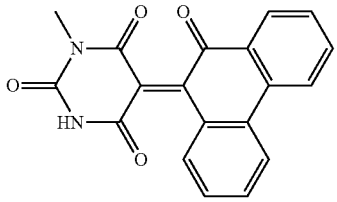 |
| E-8 | 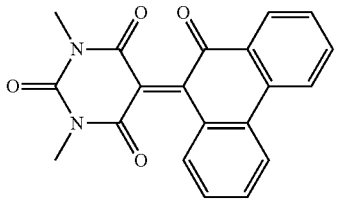 |
| E-9 | 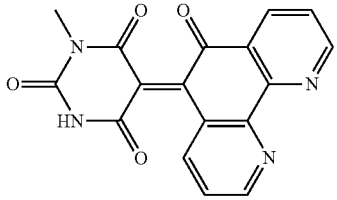 |
| E-10 | 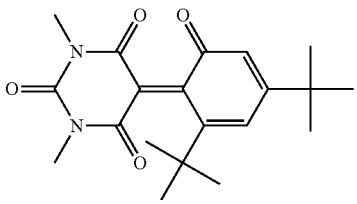 |

TABLE 1-continued
| No. | Exemplified compound |
|---|---|
| E-11 | 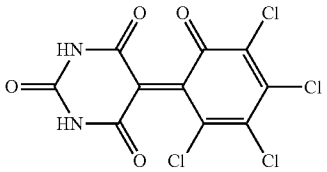 |
| E-12 | 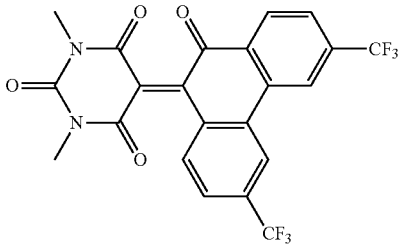 |
TABLE 2
| No. | Exemplified compound |
|---|---|
| E-13 | 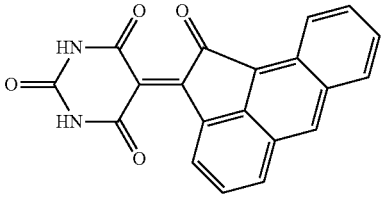 |
| E-14 | 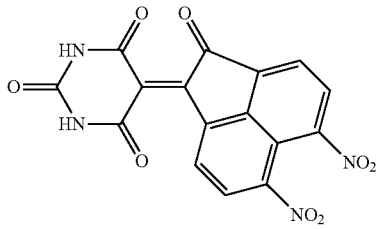 |
| E-15 | 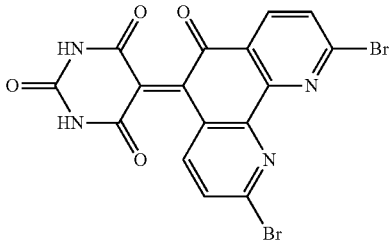 |
| E-16 | 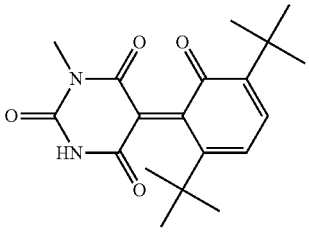 |
TABLE 2-continued
| No. | Exemplified compound |
|---|---|
| E-17 | 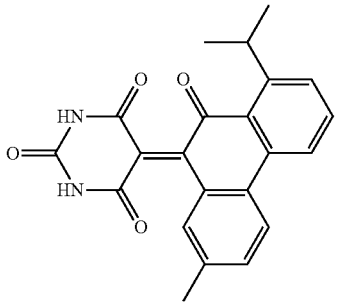 |
| E-18 | 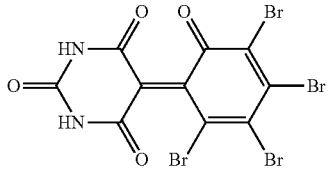 |
| E-19 | 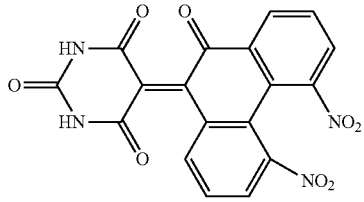 |
| E-20 | 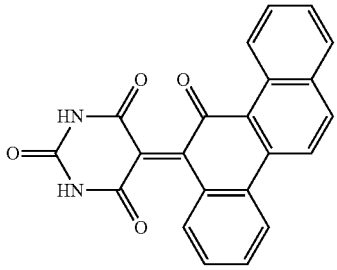 |
| E-21 | 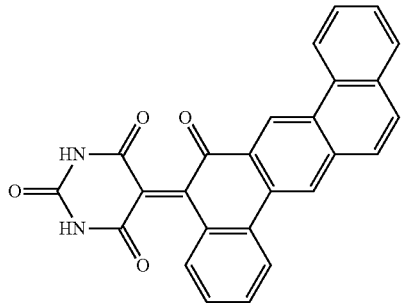 |
| E-22 | 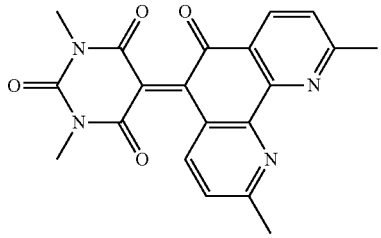 |

TABLE 2-continued

| No. | Exemplified compound |
|---|---|
| E-23 | 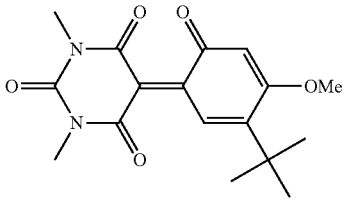 |
| E-24 | 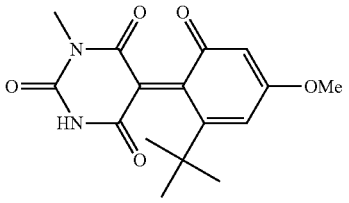 |

Intermediate Layer

Examples of a resin used for the intermediate layer of the electrophotographic photosensitive member according to aspects of the present invention include phenolic resins, epoxy resins, polyurethane resins, polycarbonate resins, polyarylate resins, polyester resins, polyamide resins, polyimide resins, polyamide-imide resins, polyamic acid resins, polyethylene resins, polyolefin resins, polystyrene resins, styrene-acrylic copolymers, acrylic resins, polymethacrylate resins, polyvinyl alcohol resins, polyvinyl acetal resins, polyvinyl butyral resins, polyvinyl formal resins, polyacrylonitrile resins, polyacrylamide resins, acrylonitrile-butadiene copolymers, polyvinyl chloride, vinyl chloride-vinyl acetate copolymers, cellulose, alkyd resins, melamine resins, alkyd-melamine resins, urethane resins, amylose, amylopectin, polysulfones, polyether sulfones, and silicone resins. From the viewpoint of achieving good effect of suppressing the formation of a ghost image, polyolefin resins, polyamide resins, alkyd-melamine resins, and urethane resins can be used. Copolymers of these resins may be used. Mixtures of one or more resins may be used.

In the case where the intermediate layer contains the compound having the structure represented by formula (1), the proportion of the compound having the structure represented by formula (1) may be in the range of 30% by mass to 80% by mass, such as 50% by mass to 75% by mass with respect to the total mass (total mass of the intermediate layer) of the resin and the compound having the structure represented by formula (1). A proportion of 30% by mass to 80% by mass results in sufficient stability of a coating solution, good coatability, and excellent suppression of the formation of a ghost image. The intermediate layer may have a thickness of 0.01 to 40 μm, such as 0.1 to 5 μm.

The intermediate layer may further contain metal oxide particles together with the compound having the structure represented by formula (1). Examples of the metal oxide particles that can be contained in the intermediate layer include particles of titanium oxide ($TiO_2$), tin oxide ($SnO_2$), zinc oxide (ZnO), aluminum oxide ($Al_2O_3$), zirconium oxide ($ZrO_2$), and indium oxide ($In_2O_3$). The metal oxide particles may be surface-treated with aluminum oxide, zirconium oxide, or a surface-treatment agent, such as a silane coupling agent. The total proportion of the metal oxide particles and the compound represented by formula (1) may be in the range of 0.5 parts by mass to 28 parts by mass, such as 1.6 parts by mass to 28 parts by mass with respect to 1 part by mass of the resin.

The metal oxide particles used in the intermediate layer can have a number-average particle size of 5 nm to 100 nm. The number-average particle size of the metal oxide particles according to aspects of the present invention may be determined by a method described below.

The particle size of the metal oxide can be measured by dynamic light scattering. Specifically, a measurement liquid having a concentration such that the metal oxide particles are not subjected to aggregation or gelation is prepared. In aspects of the present invention, the measurement liquid can have a concentration of about 0.5% to about 1% by mass with respect to a dispersion medium (measurement liquid). The measurement liquid is analyzed with a particle size measuring apparatus (Model: Zetasizer Nano series, manufactured by Sysmex Corporation) using dynamic light scattering.

In the case of incorporating the compound having the structure represented by formula (1) according to aspects of the present invention into the intermediate layer, a coating liquid for the intermediate layer may be prepared and applied onto a conductive support to form the intermediate layer. Alternatively, a conductive layer is formed on the conductive support, and a coating liquid for the intermediate layer may be applied onto the conductive layer in the same way as above, thereby forming the intermediate layer. A method for preparing the coating liquid for the intermediate layer is described below.

A resin and the compound having the structure represented by formula (1) are dissolved or dispersed in a solvent to prepare a coating liquid for the intermediate layer.

Examples of a dispersion method include methods using paint shakers, homogenizers, ultrasonic dispersers, bead mills, ball mills, sand mills, roll mills, vibration mills, attritors, homomixers, and liquid-collision type high-speed dispersers.

Examples of the solvent for use in the coating liquid for the intermediate layer include benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, dioxane, methylal, tetrahydrofuran, methanol, ethanol, propanol, isopropyl alcohol, butyl alcohol, methyl cellosolve, methoxypropanol, dimethylformamide, dimethylacetamide, dimethyl sulfoxide, and water. Among these solvents, ethyl acetate, acetone, methyl ethyl ketone, cyclohexanone, dioxane, methylal, tetrahydrofuran, methanol, ethanol, isopropyl alcohol, butyl alcohol, methoxypropanol, and water can be used.

Photosensitive Layer

In the photosensitive layer having a laminated structure, when the charge-generating layer contains the compound having the structure represented by formula (1), the proportion of the compound having the structure represented by formula (1) may be in the range of 0.1% by mass to 50% by mass, such as 1% by mass to 30% by mass with respect to the proportion of the charge-generating substance. A proportion of 0.1% by mass to 50% by mass results in sufficient stability of a coating solution, good coatability, and excellent suppression of the formation of a ghost image.

In the photosensitive layer having a laminated structure, in the case of incorporating the compound having the structure represented by formula (1) according to aspects of the present invention into the charge-generating layer, the compound having the structure represented by formula (1) and the charge-generating substance are dispersed in a solvent together with a binder resin to prepare a coating liquid for the charge-generating layer in the same way as above. The coating liquid for the charge-generating layer can be applied onto the intermediate layer and dried to form the charge-generating layer.

Examples of the charge-generating substance used for the photosensitive layer and the charge-generating layer of the electrophotographic photosensitive member according to aspects of the present invention include organic photoconductive substances, such as azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, anthanthrone pigments, pyranthrone pigments, xanthene dyes, quinone-imine dyes, and styryl dyes. Phthalocyanine pigments can be used.

Examples of phthalocyanine pigments include nonmetallic phthalocyanine, oxytitanyl phthalocyanine, hydroxygallium phthalocyanine, and halogenated gallium phthalocyanine, such as chlorogallium phthalocyanine. These charge-generating substances may be used alone or in combination of two or more.

In the photosensitive layer having a laminated structure, examples of the binder resin for use in the charge-generating layer according to aspects of the present invention include acrylic resins, allyl resins, alkyd resins, epoxy resins, diallyl phthalate resins, silicone resins, styrene-butadiene copolymers, phenolic resins, butyral resins, benzal resins, polyacrylate resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone, polyvinyl acetal resins, polybutadiene resins, polypropylene resins, methacryl resins, urea resins, vinyl chloride-vinyl acetate copolymers, vinyl acetate resins, and vinyl chloride resins. Butyral resins can be used. These resins may be used alone. Mixtures and copolymers of one or more of these resins may also be used.

The charge-generating layer may have a thickness of 0.1 to 5 μm, such as 0.1 to 2 μm. The charge-generating layer may further contain various additives, such as a sensitizer, an antioxidant, an ultraviolet absorber, and a plasticizer, as needed.

Examples of a dispersion method include methods using paint shakers, homogenizers, ultrasonic dispersers, bead mills, ball mills, sand mills, roll mills, vibration mills, attritors, homomixers, and liquid-collision type high-speed dispersers. The binder resin content can be in the range of 0.3 parts by mass to 4 parts by mass with respect to 1 part by mass of the charge-generating substance.

Conductive Support

Examples of a material for the conductive support used in aspects of the present invention include metals and alloys, such as aluminum, nickel, copper, gold, iron, and stainless steel. Further examples of the conductive support include a conductive support in which a thin film made of a metal, e.g., aluminum, silver, or gold, or a conductive material, e.g., indium oxide or tin oxide, is provided on an insulating base made of, e.g., polyester, polycarbonate, or glass; and a conductive support in which a conductive layer containing carbon or a conductive filler dispersed in a resin is provided on the insulating base. The conductive support may have a cylindrical shape or film-like shape.

In the case where the electrophotographic photosensitive member according to aspects of the present invention is used for a printer using, for example, single-wavelength laser light, a surface of the conductive support can be appropriately roughened in order to suppress interference fringes. Specifically, a conductive support produced by subjecting a surface of the conductive support to honing, blasting, cutting, electropolishing, or the like or a support including a conductive layer provided on an aluminum component or an aluminum alloy component can be used. To suppress interference fringes in an output image due to the interference of light reflected from a surface of the conductive layer, the conductive layer may further contain a surface-roughening material that roughens the surface of the conductive layer.

In the case of forming the conductive layer that includes conductive fine particles and the binder resin on the conductive support, the conductive layer includes a powder including the conductive fine particles. Examples of the conductive fine particles that can be used include titanium oxide particles and barium sulfate particles. The conductive fine particles are each covered with a conductive coating layer containing, for example, tin oxide, as needed, so as to have appropriate resistivity as a filler. The conductive fine particles may have a resistivity of 0.1 to 1000 Ω·cm, such as 1 to 1000 Ω·cm. The filler content may be in the range of 1% to 90% by mass, such as 5% to 80% by mass with respect to the conductive layer.

Examples of the binder resin for use in the conductive layer include phenolic resins, polyurethane resins, polyimide resins, polyamide resins, polyamide-imide resins, polyamic acid resins, polyvinyl acetal resins, epoxy resins, acrylic resins, melamine resins, and polyester resins. These resins may be used alone or in combination. Among these resins, in particular, phenolic resins, polyurethane resins, and polyamic acid resins can be used. The use of these resins results in satisfactory adhesion to the conductive support, improvement in the dispersibility of the filler, and satisfactory solvent resistance after film formation.

To improve the effect of suppressing interference fringes due to diffused reflection of laser light, the conductive layer may contain a surface-roughening material. As the surface-roughening material, resin particles having an average particle size of 1 to 6 μm can be used. Specific examples thereof include particles of curable rubber, polyurethane resins, epoxy resins, alkyd resins, phenolic resins, polyester resins, silicone resins, and curable resins, such as acrylic-melamine resins. Among these resin particles, silicone resin particles, which are less likely to aggregate, can be used. To improve surface properties of the conductive layer, a known leveling agent may be added.

The conductive layer may be formed by dip coating or solution coating using, for example, a Meyer bar. The conductive layer may have a thickness of 0.1 to 35 μm, such as 5 to 30 μm.

Examples of a hole-transporting substance that can be used for the photosensitive layer and the hole-transporting layer of the electrophotographic photosensitive member according to aspects of the present invention include triarylamine-based compounds, hydrazone compounds, stilbene compounds, pyrazoline-based compounds, oxazole-based compounds, triallylmethane-based compounds, and thiazole-based compounds. These hole-transporting substances may be used alone or in combination.

In the photosensitive layer having a laminated structure, examples of a binder resin for use in the hole-transporting layer include polyester resins, polycarbonate resins, polymethacrylic ester resins, polyarylate resins, polysulfone, and polystyrene resins. Among these resins, polycarbonate resins and polyarylate resins can be particularly used. These resins may be used alone or in combination.

The hole-transporting layer may have a thickness of 5 to 40 μm, such as 10 to 35 μm. The hole-transporting layer may further contain, for example, a sensitizer, an antioxidant, an ultraviolet absorber, and a plasticizer, as needed. Furthermore, the hole-transporting layer may contain, for example, a fluorine atom-containing resin and a silicone-containing resin. Moreover, the hole-transporting layer may contain fine particles composed of the resin, metal oxide fine particles, and inorganic fine particles.

A protective layer may be provided on the photosensitive layer of the electrophotographic photosensitive member according to aspects of the present invention, as needed. The protective layer contains a resin, for example, a polyvinyl butyral resin, a polyester resin, a polycarbonate resin (e.g., polycarbonate Z or modified polycarbonate), a polyamide resin, a polyimide resin, a polyarylate resin, a polyurethane resin, a phenolic resin, a styrene-butadiene copolymer, an ethylene-acrylic acid copolymer, or a styrene-acrylonitrile copolymer. The protective layer is formed by dissolving the resin in an appropriate organic solvent to prepare a solution, applying the solution onto the photosensitive layer, and drying the applied solution. The protective layer can have a thickness of 0.05 to 20 μm. The protective layer may contain, for example, conductive fine particles and an ultraviolet absorber.

Examples of application methods that can be employed in applying the coating liquids described above include dip coating, spray coating, spin coating, roller coating, Meyer bar coating, and blade coating.

Electrophotographic Apparatus

Figure 1:
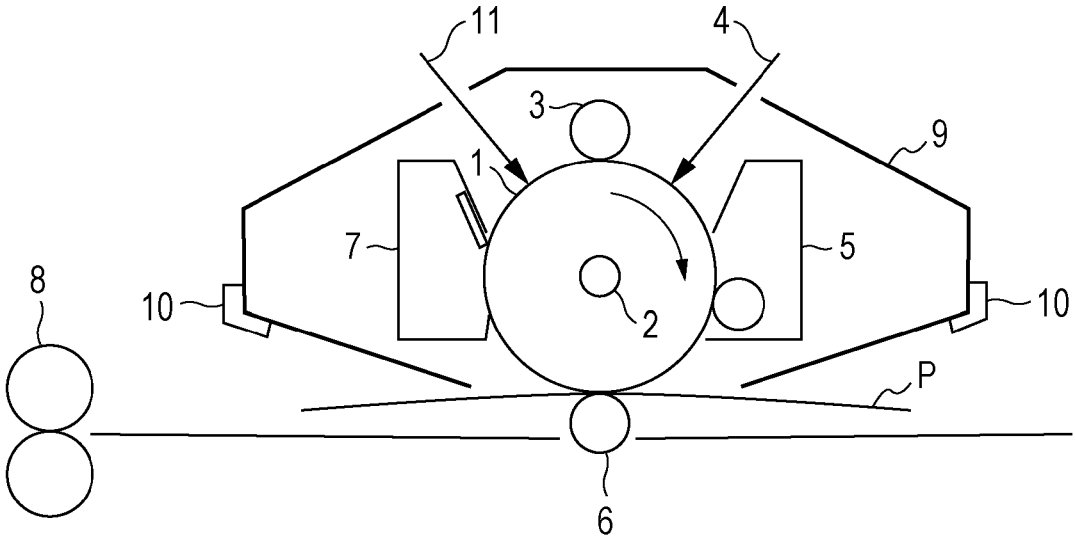
FIG. 1 schematically illustrates an exemplary structure of an electrophotographic apparatus including a process cartridge with an electrophotographic photosensitive member according to aspects of the present invention.

FIG. 1 schematically illustrates an electrophotographic apparatus including an electrophotographic photosensitive member and a process cartridge according to aspects of the present invention.

In FIG. 1, reference numeral 1 denotes a cylindrical electrophotographic photosensitive member that is rotationally driven around a shaft 2 at a predetermined peripheral speed in the direction indicated by an arrow. A surface of the electrophotographic photosensitive member 1 is uniformly charged to a predetermined negative potential with a charging device 3 during rotation and then receives exposure light 4 (light to which an image is exposed) emitted from an exposure device (not illustrated) employing, for example, slit exposure, which uses light reflected from a document, or laser beam scanning exposure. In this way, an electrostatic latent image corresponding to target image information is sequentially formed on the surface of the electrophotographic photosensitive member 1. With respect to a voltage applied to the charging device 3, a voltage obtained by superimposing an AC component on a DC component or a voltage having only a DC component may be used. In aspects of the present invention, the charging device 3 to which a voltage having only a DC component is applied is used.

The electrostatic latent image formed on the surface of the electrophotographic photosensitive member 1 is developed by reversal development with a developing device 5 using toner contained in a developer to form a toner image. The toner image formed on the surface of the electrophotographic photosensitive member 1 is sequentially transferred by a transfer bias from a transferring device 6 to a transfer material P. The transfer material P is removed from a transfer material feeding unit (not illustrated) in synchronization with the rotation of the electrophotographic photosensitive member 1 and fed to a contact portion between the electrophotographic photosensitive member 1 and the transferring device 6. A bias voltage having a polarity opposite to that of the charge of the toner is applied to the transferring device 6 from a bias supply (not illustrated). The transfer material P to which the toner image has been transferred is separated from the surface of the electrophotographic photosensitive member 1, conveyed to a fixing unit 8, and subjected to fixation of the toner image. The transferred material P is conveyed as an image formed product (print or copy) to the outside of the apparatus.

The surface of the electrophotographic photosensitive member 1 after the transfer of the toner image is cleaned by removing the residual developer after the transfer (residual toner after the transfer) with a cleaning device 7. The electrophotographic photosensitive member 1 is subjected to charge elimination by pre-exposure light 11 emitted from a pre-exposure device (not illustrated) and then is repeatedly used for image formation. As the transferring device, a transferring device employing an intermediate transfer method using a belt- or drum-like intermediate transfer member may be used.

In aspects of the present invention, plural components selected from the components, such as the electrophotographic photosensitive member 1, the charging device 3, the developing device 5, and the cleaning device 7, may be arranged in a housing and integrally formed into a process cartridge. The process cartridge may be detachably attached to the main body of an electrophotographic apparatus, for example, a copier or a laser beam printer. For example, the electrophotographic photosensitive member 1, the charging device 3, the developing device 5, and the cleaning device 7 may be integrally formed into a process cartridge 9 detachably attached to the main body of the electrophotographic apparatus using a guiding member 10, such as a rail, of the main body of the electrophotographic apparatus.

EXAMPLES

Aspects of the present invention will be described in more detail below by examples and comparative examples. However, aspects of the present invention are not limited to the examples described below.

The compound having the structure represented by formula (1) used in aspects of the present invention may be synthesized on the basis of a known example (Indian Journal of Chemistry, Section B: Organic Chemistry Including Medicinal Chemistry, 44B, 6, p. 1252, 2005).

Synthesis Example 1

Exemplified Compound E-1

In a reaction vessel, 1.28 parts by mass of barbituric acid (manufactured by Sigma-Aldrich Corp.) and 2.08 parts by mass of 9,10-phenanthrenequinone (manufactured by Sigma-Aldrich Corp.) were mixed. Then 160 parts by mass of ethanol and 16 parts by mass of tetrahydrofuran (THF) were added thereto. The resulting mixture was refluxed by heating for 9 hours under a nitrogen stream. After the completion of the reaction, the solvent was removed by suction filtration. The residue was dissolved in chloroform and purified by silica-gel column chromatography. The resulting fractions were collected and concentrated. Recrystallization from 1:3 ethanol-chloroform provided 1.22 parts by mass of target exemplified compound E-1. The molecular weight was measured with a mass spectrometer (MALDI-TOF MS, manufactured by Bruker Daltonics Corp., accelerating voltage: 20 kV, mode: Reflector, molecular-weight standard molecule: fullerene C60) and found to be 318 as a peak top value, which identified the resulting compound as target exemplified compound E-1.

Synthesis Example 2

Exemplified Compound E-5

In a reaction vessel, 1.28 parts by mass of barbituric acid (manufactured by Sigma-Aldrich Corp.) and 1.82 parts by mass of acenaphthenequinone (manufactured by Sigma-Aldrich Corp.) were mixed. Then 160 parts by mass of ethanol and 16 parts by mass of tetrahydrofuran (THF) were added thereto. The resulting mixture was refluxed by heating for 9 hours under a nitrogen stream. After the completion of the reaction, the solvent was removed by suction filtration. The residue was dissolved in chloroform and purified by silica-gel column chromatography. The resulting fractions were collected and concentrated. Recrystallization from 1:3 ethanol-chloroform provided 1.1 parts by mass of target exemplified compound E-5. The molecular weight was measured with a mass spectrometer (MALDI-TOF MS, manufactured by Bruker Daltonics Corp., accelerating voltage: 20 kV, mode: Reflector, molecular-weight standard molecule: fullerene C60) and found to be 292 as a peak top value, which identified the resulting compound as target exemplified compound E-5.

Exemplified compounds other than those described above were also synthesized in the same way as above. Pyrimidinetrione derivatives and diketone derivatives, which serve as raw materials for the exemplified compounds, are shown in Tables 3 and 4.

TABLE 3

| | Raw material (manufactured by Sigma-Aldrich Corp.) | |
|---|---|---|
| Exemplified compound | Pyrimidinetrione derivative | Diketone derivative |
| E-1 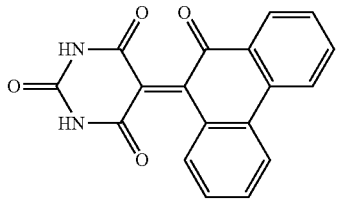 | 2,4,6(1H,3H,5H)-pyrimidinetrione 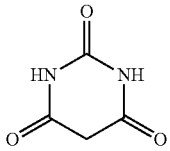 | 9,10-Phenanthrenequinone 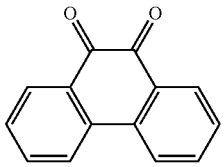 |
| E-2 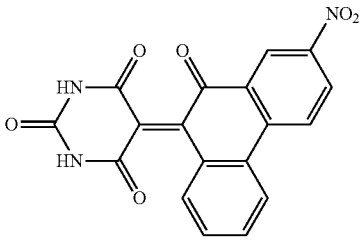 | 2,4,6(1H,3H,5H)-pyrimidinetrione 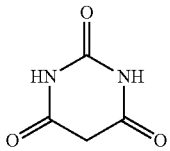 | 2-Nitrophenanthraquinone 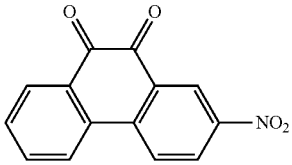 |
| E-3 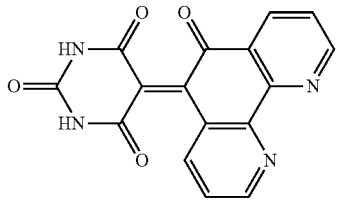 | 2,4,6(1H,3H,5H)-pyrimidinetrione 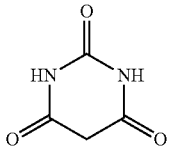 | 1,10-Phenanethroline-5,6-dione 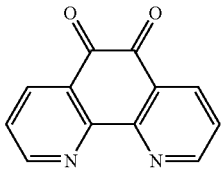 |
| E-4 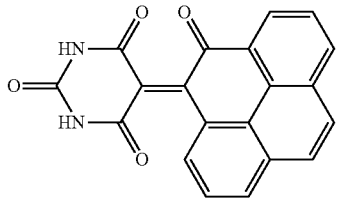 | 2,4,6(1H,3H,5H)-pyrimidinetrione 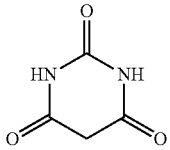 | Pyrene-4,5-dione 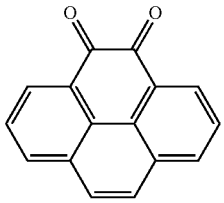 |
| E-5 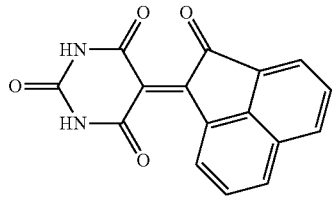 | 2,4,6(1H,3H,5H)-pyrimidinetrione 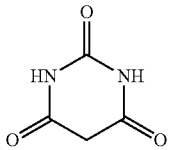 | Acenaphthenequinone 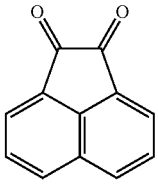 |

TABLE 4

| Exemplified compound | Raw material (manufactured by Sigma-Aldrich Corp.) Pyrimidinetrione derivative | Diketone derivative |
|---|---|---|
| E-6 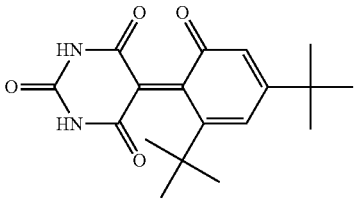 | 2,4,6(1H,3H,5H)-pyrimidinetrione 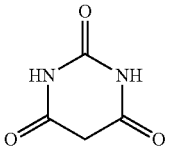 | 3,5-Di-tert-butyl-o-benzoquinone 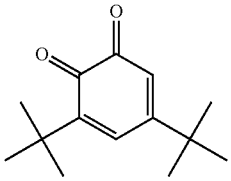 |
| E-7 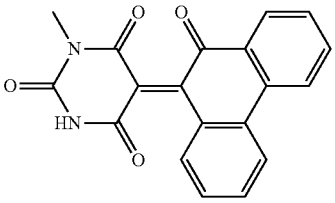 | 1-Methyl-2,4,6(1H,3H,5H)-pyrimidinetrione 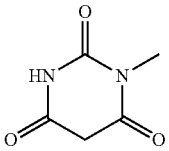 | 9,10-Phenanthrenequinone 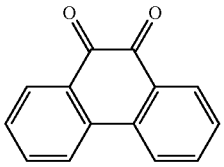 |
| E-8 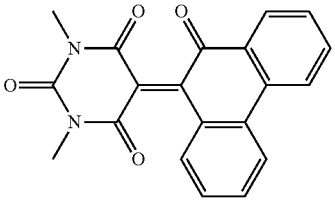 | 1,3-Dimethyl-2,4,6(1H,3H,5H)-pyrimidinetrione 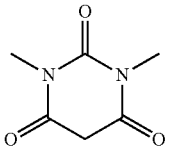 | 9,11-Phenanthrenequinone 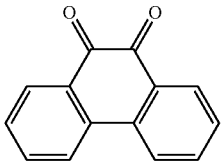 |
| E-9 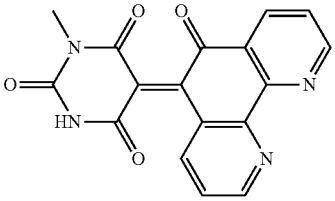 | 1-Methyl-2,4,6(1H,3H,5H)-pyrimidinetrione 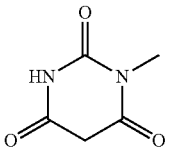 | 1,10-Phenanethroline-5,6-dione 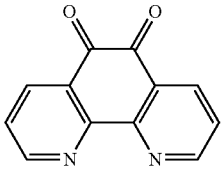 |
| E-10 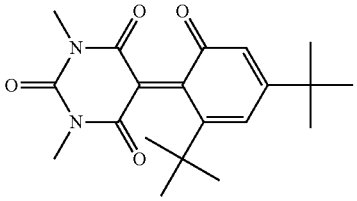 | 1,3-Dimethyl-2,4,6(1H,3H,5H)-pyrimidinetrione 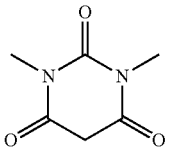 | 3,5-Di-tert-butyl-o-benzoquinone 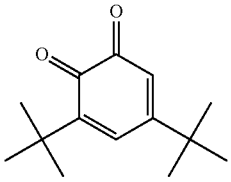 |
| E-11 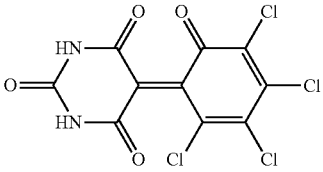 | 2,4,6(1H,3H,5H)-pyrimidinetrione 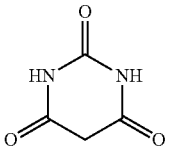 | 3,4,5,6-tetrachloro-benzoquinone 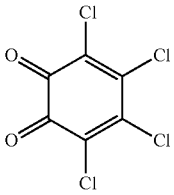 |

Example 1

An aluminum cylinder (JIS-A3003, aluminum alloy) of 257 mm in length and 24 mm in diameter was prepared. Next, 50 parts by mass of titanium oxide particles coated with oxygen-deficient tin oxide (resistivity of the powder: 120 Ω·cm, coverage of $SnO_2$ on a mass percent basis: 40%), 40 parts by mass of phenolic resin (Plyophen J-325, manufactured by DIC Corporation, resin solid content: 60%), and 40 parts by mass of methoxypropanol were subjected to dispersion for 3 hours with a sand mill using glass beads each having a diameter of 1 mm, thereby preparing a coating liquid for a conductive layer (hereinafter, referred to as a "conductive layer coating liquid"). The conductive layer coating liquid was applied on the aluminum cylinder by dip coating. The resulting film was cured by heating at 145° C. for 30 minutes to form a conductive layer having a thickness of 15 μm. The number-average particle size of the titanium oxide particles coated with oxygen-deficient tin oxide in the conductive layer coating liquid was measured with a particle-size distribution analyzer (Model: CAPA-700, manufactured by Horiba Ltd). Specifically, the number-average particle size of the titanium oxide particles was measured by centrifugal sedimentation using tetrahydrofuran (THF) at 5000 rpm and found to be 0.32 μm.

Polyolefin used for the intermediate layer of the electrophotographic photosensitive member according to aspects of the present invention may be synthesized by a method described below. Polyolefin may be synthesized by a method described in, for example, Chapter 4 in "Shin Koubunshi Jikken Gaku 2, Koubunshi no Gousei and Han-nou (1) (New Polymer Experiments 2, Preparation and Reaction of Polymers (1)) (published by Kyoritsu Shuppan Co., Ltd.), Japanese Patent Laid-Open No. 2003-105145, or Japanese Patent Laid-Open No. 2003-147028.

A pressure-proof, sealable 1-L glass container equipped with a heater and a stirrer was used. Into the glass container, 80.0 parts by mass of polyolefin (trade name: Bondine HX8290, manufactured by Sumitomo Chemical Co., Ltd.), 30.0 parts by mass of ethanol, 3.9 parts by mass of N,N-dimethylethanolamine, and 206.1 parts by mass of distilled water were charged. The mixture was stirred at a rotational speed of a stirring blade of 300 rpm. The precipitation of resin granules were not observed at the bottom of the container, but the resin granules floated. The mixture continued to be stirred. After 10 minutes, the heater was turned on to heat the mixture. The mixture was stirred for another 20 minutes while the system was maintained at 140° C. The mixture was placed in a water bath and cooled to room temperature (about 25° C.) under stirring at 300 rpm. The mixture was filtered under pressure at an air pressure of 0.2 MPa with a plain weave 300-mesh stainless steel filter having a wire diameter of 0.035 mm to provide a uniform, milky white aqueous dispersion of a polyolefin resin having a solid content of 25% and a viscosity-average molecular weight of 27,000 to 28,000.

Next, 5.3 parts by mass of the aqueous dispersion of the polyolefin resin, 2.7 parts by mass of exemplified compound E-1, 40 parts by mass of isopropyl alcohol, and 40 parts by mass of water were subjected to dispersion treatment for 12 hours with a paint shaker using glass beads each having a diameter of 1 mm, thereby preparing a coating liquid for an intermediate layer (hereinafter, referred to as an "intermediate layer coating liquid") used for the electrophotographic photosensitive member. The intermediate layer coating liquid was applied on the conductive layer by dip coating. The resulting film was dried at 120° C. for 10 minutes to form an intermediate layer having a thickness of 1 μm.

Next, 10 parts by mass of crystalline hydroxygallium phthalocyanine (HOGaPc) showing strong peaks at Bragg angles (2θ±0.2°) of 7.5°, 9.9°, 16.3°, 18.6°, 25.1°, and 28.3° measured in X-ray diffraction using CuKα radiation was prepared. Five parts by mass of polyvinyl butyral (S-Lec BX-1, manufactured by Sekisui Chemical Co., Ltd.) and 260 parts by mass of cyclohexanone were added thereto. The mixture was subjected to dispersion treatment for 1.5 hours with a sand mill using glass beads each having a diameter of 1 mm. After the completion of the dispersion treatment, 240 parts by mass of ethyl acetate was added thereto, thus preparing a coating liquid for a charge-generating layer (hereinafter, referred to as a "charge-generating layer coating liquid"). The charge-generating layer coating liquid was applied on the intermediate layer by dip coating. The resulting film was dried at 100° C. for 10 minutes to form a charge-generating layer having a thickness of 0.17 μm.

Next, 6 parts by mass of an amine compound having a structure represented by formula (2), 2 parts by mass of an amine compound having a structure represented by formula (3), and 10 parts by mass of a polyarylate having a structural unit represented by formula (4) (weight-average molecular weight [Mw]: 100,000, a ratio of an isophthalic acid skeleton to a terephthalic acid skeleton of 1:1) were dissolved in a mixed solvent such that the final ratio by weight of monochlorobenzene to dimethoxymethane was 7:3. Thereby, a coating liquid for a hole-transporting layer (hereinafter, referred to as a "hole-transporting layer coating liquid") was prepared. The weight-average molecular weight (Mw) of the polyarylate was measured with a gel permeation chromatograph (Model: HLC-8120, manufactured by Tosoh Corporation) and calculated in terms of polystyrene.

(2)

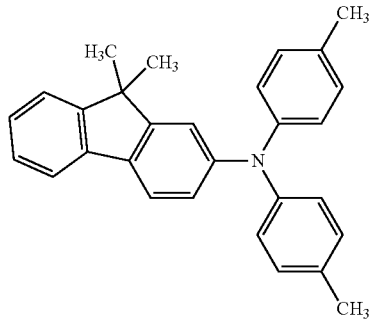

(3)

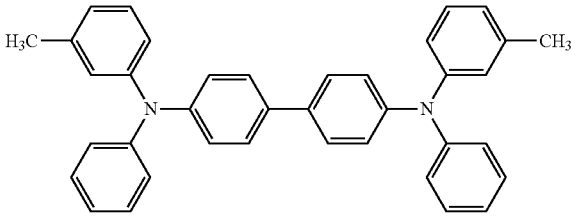

(4)

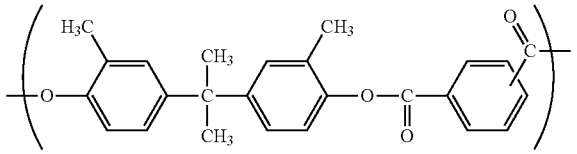

The hole-transporting layer coating liquid was applied on the charge-generating layer by dip coating. The resulting film was dried at 120° C. for 1 hour to form a hole-transporting layer having a thickness of 16 μm. In this way, an electrophotographic photosensitive member according to Example 1 was produced, the member including the conductive layer, the intermediate layer, the charge-generating layer, and the hole-transporting layer.

Examples 2 to 14

Electrophotographic photosensitive members were produced as in Example 1, except that in each of Examples 2 to 14, the type and proportion of the compound having the structure represented by formula (1) in the intermediate layer coating liquid were changed as described in Table 5.

Example 15

An electrophotographic photosensitive member was produced as in Example 1, except that an intermediate layer coating liquid prepared as described below was used. The intermediate layer coating liquid was prepared by subjecting a mixture of 1 part by mass of a polyamide (Amilan CM8000, manufactured by Toray Industries, Inc.), 2 parts by mass of exemplified compound E-1, 20 parts by mass of butanol, and 40 parts by mass of methanol to dispersion for 10 hours with a paint shaker using glass beads each having a diameter of 1 mm.

Example 16

An electrophotographic photosensitive member was produced as in Example 1, except that an intermediate layer coating liquid prepared as described below was used and that the drying temperature after the dip coating was changed to 150° C. for 20 minutes. The intermediate layer coating liquid was prepared by subjecting a mixture of 0.6 parts by mass of an alkyd resin (Beckolite M-6401-50, manufactured by DIC Corporation), 0.4 parts by mass of a melamine resin (Super Beckamine G-821-60, manufactured by DIC Corporation), 2 parts by mass of exemplified compound E-1, and 60 parts by mass of 2-butanone to dispersion for 12 hours with a paint shaker using glass beads each having a diameter of 1 mm.

Example 17

An electrophotographic photosensitive member was produced as in Example 1, except that an intermediate layer coating liquid prepared as described below was used and that the drying temperature after the dip coating was changed to 170° C. for 20 minutes. The intermediate layer coating liquid was prepared by subjecting a mixture of 0.57 parts by mass of a blocked isocyanate (Sumijule 3173, manufactured by Sumika Bayer Urethane Co., Ltd), 0.43 parts by mass of a butyral resin (BM-1, manufactured by Sekisui Chemical Co., Ltd.), 2 parts by mass of exemplified compound E-1, 48 parts by mass of 2-butanone, and 12 parts by mass of n-hexane to dispersion for 12 hours with a paint shaker using glass beads each having a diameter of 1 mm. Then 0.005 parts by mass of dioctyl tin dilaurate serving as a catalyst was added to 100 parts by mass of the dispersion, thereby preparing the intermediate layer coating liquid.

Example 18

An electrophotographic photosensitive member was produced as in Example 1, except that an intermediate layer coating liquid prepared as described below was used. The intermediate layer coating liquid for the electrophotographic photosensitive member was prepared by adding 2.1 parts by mass of exemplified compound E-1, 19 parts by mass of tin oxide particles, and 4 parts by mass of the aqueous dispersion of the polyolefin resin prepared in Example 1 to a mixed solvent of 110 parts by mass of isopropyl alcohol and 110 parts by mass of water and subjecting the resulting mixture to dispersion for 16 hours with a paint shaker using glass beads each having a diameter of 1 mm.

Examples 19 and 20

Electrophotographic photosensitive members were produced as in Example 18, except that in each of Examples 19 and 20, the type and proportion of the metal oxide particles and the compound having the structure represented by formula (1) in the intermediate layer coating liquid were changed as described in Table 5.

Example 21

An electrophotographic photosensitive member was produced as in Example 1, except that an intermediate layer coating liquid and a charge-generating layer coating liquid prepared as described below were used. The intermediate layer coating liquid was prepared by subjecting a mixture of 3 parts by mass of polyamide (Amilan CM8000, manufactured by Toray Industries, Inc.), 20 parts by mass of butanol, and 40 parts by mass of methanol to dispersion for 10 hours with a paint shaker using glass beads each having a diameter of 1 mm. With respect to the charge-generating layer coating liquid, 10 parts by mass of hydroxygallium phthalocyanine in Example 1, 3 parts by mass of exemplified compound E-1, 5 parts by mass of polyvinyl butyral (S-Lec BX-1, manufactured by Sekisui Chemical Co., Ltd.), and 260 parts by mass of cyclohexanone were mixed. The resulting mixture was subjected to dispersion for 1.5 hours with a sand mill using glass beads each having a diameter of 1 mm. The addition of 240 parts by mass of ethyl acetate to the dispersion resulted in the charge-generating layer coating liquid.

Examples 22 to 28

Electrophotographic photosensitive members were produced as in Example 21, except that in each of Examples 22 to 28, the type and proportion of the compound having the structure represented by formula (1) in the charge-generating layer coating liquid were changed as described in Tables 5 and 6.

Example 29

An electrophotographic photosensitive member was produced as in Example 1, except that the intermediate layer coating liquid in Example 1 and the charge-generating layer coating liquid in Example 21 were used.

Examples 30 and 31

Electrophotographic photosensitive members were produced as in Example 29, except that in each of Examples 30 and 31, the type and proportion of the compound having the structure represented by formula (1) in the intermediate layer coating liquid were changed as described in Table 6.

Example 32

An electrophotographic photosensitive member was produced as in Example 29, except that an intermediate layer coating liquid prepared as described below was used. The intermediate layer coating liquid for the electrophotographic photosensitive member was prepared by adding 2.1 parts by mass of exemplified compound E-4, 19 parts by mass of tin oxide particles, and 4 parts by mass of the aqueous dispersion of the polyolefin resin prepared in Example 1 to a mixed solvent of 110 parts by mass of isopropyl alcohol and 110 parts by mass of water and subjecting the resulting mixture to dispersion for 16 hours with a paint shaker using glass beads each having a diameter of 1 mm.

Example 33

An electrophotographic photosensitive member was produced as in Example 29, except that an intermediate layer coating liquid prepared as described below was used. A mixture of 100 parts by mass of zinc oxide (volume-average particle size: 70 nm, manufactured by Tayca Corporation) and 500 parts by mass of THF was stirred. Then 1.25 parts by mass of N-β-(aminoethyl)-γ-aminopropyltrimethoxysilane (KBM603, manufactured by Shin-Etsu Chemical Co., Ltd.) was added thereto. The mixture was stirred for another 2 hours to prepare a dispersion. The resulting dispersion was evaporated under reduced pressure and baked at 120° C. for 3 hours to produce zinc oxide particles surface-treated with the silane coupling agent. To a mixed solvent of 110 parts by mass of isopropyl alcohol and 110 parts by mass of water, 1.5 parts by mass of exemplified compound E-1, 15 parts by mass of the resulting zinc oxide particles surface-treated with the silane coupling agent, and 4 parts by mass of the aqueous dispersion of the polyolefin resin prepared in Example 1 were added. The resulting mixture was subjected to dispersion for 16 hours with a paint shaker using glass beads each having a diameter of 1 mm, thereby preparing the intermediate layer coating liquid used for the electrophotographic photosensitive member.

Comparative Example 1

An electrophotographic photosensitive member was produced as in Example 1, except that an intermediate layer coating liquid prepared as described below was used. An exemplified compound was not used, and 5.3 parts by mass of the aqueous dispersion of the polyolefin resin in Example 1 was diluted with a mixed solvent of 230 parts by mass of isopropyl alcohol and 230 parts by mass of water, thereby preparing the intermediate layer coating liquid used for the electrophotographic photosensitive member.

Comparative Example 2

An electrophotographic photosensitive member was produced as in Example 1, except that the intermediate layer coating liquid was prepared using comparative compound C-1 in place of exemplified compound E-1, comparative compound C-1 being represented by the following formula:

(C-1)

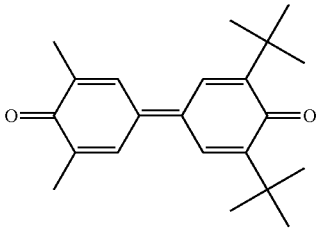

Comparative Example 3

An electrophotographic photosensitive member was produced as in Example 1, except that the intermediate layer coating liquid was prepared using comparative compound C-2 in place of exemplified compound E-1, comparative compound C-2 being represented by the following formula:

(C-2)

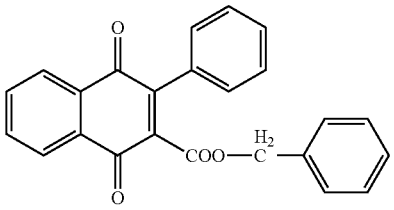

Comparative Example 4

An electrophotographic photosensitive member was produced as in Example 1, except that the intermediate layer coating liquid was prepared using comparative compound C-3 in place of exemplified compound E-1, comparative compound C-3 being represented by the following formula:

(C-3)

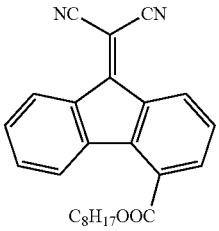

Comparative Example 5

An electrophotographic photosensitive member was produced as in Example 1, except that the intermediate layer coating liquid was prepared using comparative compound C-4 in place of exemplified compound E-1, comparative compound C-4 being represented by the following formula:

(C-4)

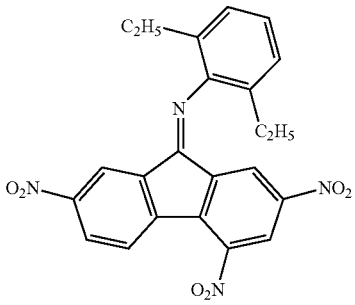

Comparative Example 6

An electrophotographic photosensitive member was produced as in Example 1, except that the intermediate layer coating liquid was prepared using comparative compound C-5 in place of exemplified compound E-1, comparative compound C-5 being represented by the following formula:

(C-5)

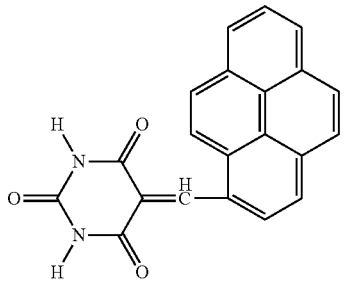

Comparative Example 7

An electrophotographic photosensitive member was produced as in Example 18, except that an intermediate layer coating liquid prepared as described below was used. An exemplified compound was not used, and 21 parts by mass of tin oxide particles and 4 parts by mass of the aqueous dispersion of the polyolefin resin in Example 1 were added to a mixed solvent of isopropyl alcohol and 110 parts by mass of water. The resulting mixture was subjected to dispersion for 16 hours with a paint shaker using glass beads each having a diameter of 1 mm, thereby preparing the intermediate layer coating liquid used for the electrophotographic photosensitive member.

Comparative Examples 8 and 9

Electrophotographic photosensitive members were produced as in Comparative Example 6, except that in each of Comparative Examples 8 and 9, the type and proportion of the metal oxide particles in the intermediate layer coating liquid were changed as described in Table 6.

Comparative Example 10

An electrophotographic photosensitive member was produced as in Example 21, except that the intermediate layer coating liquid was prepared using comparative compound C-1 in place of exemplified compound E-1. The composition of the charge-generating layer coating liquid was described in Table 6.

Comparative Example 11

An electrophotographic photosensitive member was produced as in Example 22, except that the intermediate layer coating liquid was prepared using comparative compound C-2 in place of exemplified compound E-1. The composition of the charge-generating layer coating liquid was described in Table 6.

TABLE 5

| | | Example | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Composition of coating liquid for intermediate layer | | | | | | | | | | | | |
| Exemplified compound | E-1 | 2.7 | 4 | 1.34 | 0.57 | | | | | | | |
| | E-2 | | | | | 2.7 | | | | | | |
| | E-3 | | | | | | 2.7 | | | | | |
| | E-4 | | | | | | | 2.7 | | | | |
| | E-5 | | | | | | | | 2.7 | | | |
| | E-6 | | | | | | | | | 2.7 | | |
| | E-7 | | | | | | | | | | 2.7 | |
| | E-8 | | | | | | | | | | | 4.0 |
| | E-9 | | | | | | | | | | | |
| | E-10 | | | | | | | | | | | |
| | E-11 | | | | | | | | | | | |
| Comparative compound | C-1 | | | | | | | | | | | |
| | C-2 | | | | | | | | | | | |
| | C-3 | | | | | | | | | | | |
| | C-4 | | | | | | | | | | | |
| | C-5 | | | | | | | | | | | |
| Binder resin | Aqueous dispersion of polyolefin resin | 5.3 | 5.3 | 5.3 | 5.3 | 5.3 | 5.3 | 5.3 | 5.3 | 5.3 | 5.3 | 5.3 |
| | Polyamide resin | | | | | | | | | | | |
| | Alkyd-melamine resin | | | | | | | | | | | |
| | Urethane resin | | | | | | | | | | | |
| Metal oxide | Tin oxide | | | | | | | | | | | |
| | Titanium oxide | | | | | | | | | | | |
| | Zinc oxide | | | | | | | | | | | |
| Composition of coating liquid for charge-generating layer | | | | | | | | | | | | |
| Exemplified compound | E-1 | | | | | | | | | | | |
| | E-2 | | | | | | | | | | | |
| | E-3 | | | | | | | | | | | |
| | E-4 | | | | | | | | | | | |
| Comparative compound | C-1 | | | | | | | | | | | |
| | C-2 | | | | | | | | | | | |
| Binder resin | Polyvinyl butyral | 5 | 5 | 5 | 5 | 5 | 5 | 5 | 5 | 5 | 5 | 5 |
| Charge-generating substance | Hydroxygallium phthalocyanine | 10 | 10 | 10 | 10 | 10 | 10 | 10 | 10 | 10 | 10 | 10 |

TABLE 5-continued

| | | Example | | | | | | | | | | |
|---|---|---|---|---|---|---|---|---|---|---|---|---|
| | | 12 | 13 | 14 | 15 | 16 | 17 | 18 | 19 | 20 | 21 | 22 |
| Composition of coating liquid for intermediate layer | | | | | | | | | | | | |
| Exemplified compound | E-1 | | | | 2.0 | 2.0 | 2.0 | 2.1 | 1.2 | 1.5 | | |
| | E-2 | | | | | | | | | | | |
| | E-3 | | | | | | | | | | | |
| | E-4 | | | | | | | | | | | |
| | E-5 | | | | | | | | | | | |
| | E-6 | | | | | | | | | | | |
| | E-7 | | | | | | | | | | | |
| | E-8 | | | | | | | | | | | |
| | E-9 | 1.34 | | | | | | | | | | |
| | E-10 | | 2.7 | | | | | | | | | |
| | E-11 | | | 2.7 | | | | | | | | |
| Comparative compound | C-1 | | | | | | | | | | | |
| | C-2 | | | | | | | | | | | |
| | C-3 | | | | | | | | | | | |
| | C-4 | | | | | | | | | | | |
| | C-5 | | | | | | | | | | | |
| Binder resin | Aqueous dispersion of polyolefin resin | 5.3 | 5.3 | 5.3 | | | | 4.0 | 4.0 | 4.0 | | |
| | Polyamide resin | | | | 1.0 | | | | | | 3.0 | 3.0 |
| | Alkyd-melamine resin | | | | | 1.0 | | | | | | |
| | Urethane resin | | | | | | 1.0 | | | | | |
| Metal oxide | Tin oxide | | | | | | | 19.0 | | | | |
| | Titanium oxide | | | | | | | | 11.0 | | | |
| | Zinc oxide | | | | | | | | | 15.0 | | |
| Composition of coating liquid for charge-generating layer | | | | | | | | | | | | |
| Exemplified compound | E-1 | | | | | | | | | | 3.0 | 1.0 |
| | E-2 | | | | | | | | | | | |
| | E-3 | | | | | | | | | | | |
| | E-4 | | | | | | | | | | | |
| Comparative compound | C-1 | | | | | | | | | | | |
| | C-2 | | | | | | | | | | | |
| Binder resin | Polyvinyl butyral | 5 | 5 | 5 | 5 | 5 | 5 | 5 | 5 | 5 | 5 | 5 |
| Charge-generating substance | Hydroxygallium phthalocyanine | 10 | 10 | 10 | 10 | 10 | 10 | 10 | 10 | 10 | 10 | 10 |

TABLE 6

| | | Example | | | | | | | | | | Comparative example | | |
|---|---|---|---|---|---|---|---|---|---|---|---|---|---|---|
| | | 23 | 24 | 25 | 26 | 27 | 28 | 29 | 30 | 31 | 32 | 1 | 2 | 3 |
| Composition of coating liquid for intermediate layer | | | | | | | | | | | | | | |
| Exemplified compound | E-1 | | | | | | | 2.7 | | | | | | |
| | E-2 | | | | | | | | 2.7 | | | | | |
| | E-3 | | | | | | | | | 2.7 | | | | |
| | E-4 | | | | | | | | | | 21 | | | |
| | E-5 | | | | | | | | | | | | | |
| | E-6 | | | | | | | | | | | | | |
| | E-7 | | | | | | | | | | | | | |
| | E-8 | | | | | | | | | | | | | |
| | E-9 | | | | | | | | | | | | | |
| | E-10 | | | | | | | | | | | | | |
| Comparative compound | C-1 | | | | | | | | | | | | 2.7 | |
| | C-2 | | | | | | | | | | | | | 2.7 |
| | C-3 | | | | | | | | | | | | | |
| | C-4 | | | | | | | | | | | | | |
| | C-5 | | | | | | | | | | | | | |
| Binder resin | Aqueous dispersion of polyolefin resin | | | | | | | 5.3 | 5.3 | 5.3 | 4.0 | 5.3 | 5.3 | 5.3 |
| | Polyamide resin | 3.0 | 3.0 | 3.0 | 3.0 | 3.0 | 3.0 | | | | | | | |
| | Alkyd-melamine resin | | | | | | | | | | | | | |
| | Urethane resin | | | | | | | | | | | | | |
| Metal oxide | Tin oxide | | | | | | | | | | 19.0 | | | |
| | Titanium oxide | | | | | | | | | | | | | |
| | Zinc oxide | | | | | | | | | | | | | |

TABLE 6-continued

| | | | | | | | | | | | | | | |
|---|---|---|---|---|---|---|---|---|---|---|---|---|---|---|
| Composition of coating liquid for charge-generating layer | | | | | | | | | | | | | | |
| Exemplified compound | E-1 | 0.5 | 0.1 | 5.0 | | | | 3.0 | 3.0 | 3.0 | 3.0 | | | |
| | E-2 | | | | 1.0 | | | | | | | | | |
| | E-3 | | | | | 1.0 | | | | | | | | |
| | E-4 | | | | | | 1.0 | | | | | | | |
| Comparative compound | C-1 | | | | | | | | | | | | | |
| | C-2 | | | | | | | | | | | | | |
| Binder resin | Polyvinyl butyral | 5 | 5 | 5 | 5 | 5 | 5 | 5 | 5 | 5 | 5 | 5 | 5 | 5 |
| Charge-generating substance | Hydroxygallium phthalocyanine | 10 | 10 | 10 | 10 | 10 | 10 | 10 | 10 | 10 | 10 | 10 | 10 | 10 |

| | | Comparative example | | | | | | | |
|---|---|---|---|---|---|---|---|---|---|
| | | 4 | 5 | 6 | 7 | 8 | 9 | 10 | 11 |
| Composition of coating liquid for intermediate layer | | | | | | | | | |
| Exemplified compound | E-1 | | | | | | | | |
| | E-2 | | | | | | | | |
| | E-3 | | | | | | | | |
| | E-4 | | | | | | | | |
| | E-5 | | | | | | | | |
| | E-6 | | | | | | | | |
| | E-7 | | | | | | | | |
| | E-8 | | | | | | | | |
| | E-9 | | | | | | | | |
| | E-10 | | | | | | | | |
| Comparative compound | C-1 | | | | | | | | |
| | C-2 | | | | | | | | |
| | C-3 | 2.7 | | | | | | | |
| | C-4 | | 2.7 | | | | | | |
| | C-5 | | | 2.7 | | | | | |
| Binder resin | Aqueous dispersion of polyolefin resin | 5.3 | 5.3 | 5.3 | 4.0 | | | | |
| | Polyamide resin | | | | | | | 3.0 | 3.0 |
| | Alkyd-melamine resin | | | | | | | | |
| | Urethane resin | | | | | | | | |
| Metal oxide | Tin oxide | | | | 21.0 | | | | |
| | Titanium oxide | | | | | 12.0 | | | |
| | Zinc oxide | | | | | | 17.0 | | |
| Composition of coating liquid for charge-generating layer | | | | | | | | | |
| Exemplified compound | E-1 | | | | | | | | |
| | E-2 | | | | | | | | |
| | E-3 | | | | | | | | |
| | E-4 | | | | | | | | |
| Comparative compound | C-1 | | | | | | | 3.0 | |
| | C-2 | | | | | | | | 1.0 |
| Binder resin | Polyvinyl butyral | 5 | 5 | 5 | 5 | 5 | 5 | 5 | 5 |
| Charge-generating substance | Hydroxygallium phthalocyanine | 10 | 10 | 10 | 10 | 10 | 10 | 10 | 10 |

Values in Tables 5 and 6 indicate the proportions (parts by mass) of the materials in the intermediate layer coating liquid or the charge-generating layer coating liquid.

Evaluation

A method for evaluating the electrophotographic photosensitive members produced in Examples 1 to 33 and Comparative Examples 1 to 11 is described below.

Figure 3:
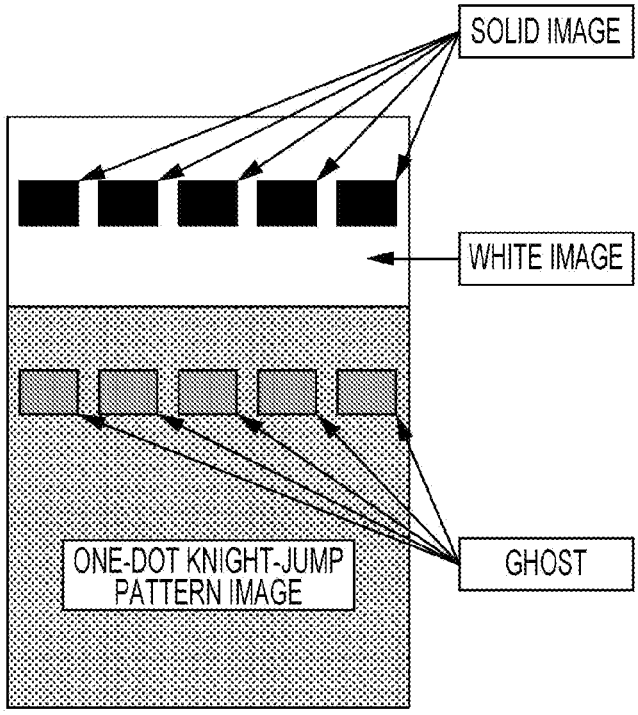
FIG. 3 illustrates a print for evaluating a ghost used in evaluating a ghost image.
Figure 4:
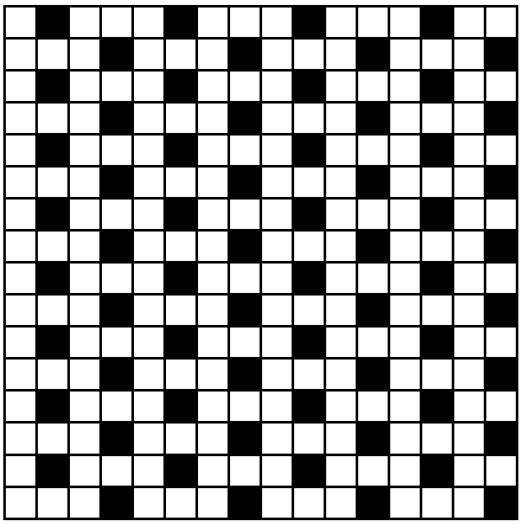
FIG. 4 illustrates a one-dot, knight-jump pattern image.

A laser beam printer (Model: Laser Jet 3550, manufactured by Hewlett-Packard Development Company) was used as an evaluation apparatus. The electrophotographic photosensitive member was mounted on a cyan process cartridge. The resulting process cartridge was mounted on a station for a cyan process cartridge. After printing 5000 copies in an environment with a temperature of 15° C. and a humidity of 10% RH, the evaluation of an image was performed. The surface potential of a drum was set so as to have an initial dark potential of −500V and an initial light potential of −170V. The surface potential of the electrophotographic photosensitive member was measured as follows: The cartridge was modified. A potential probe (model 6000B-8, manufactured by TREK JAPAN) was mounted at a developing position. A potential at the central portion of the drum was measured with a surface potentiometer (model 344, manufactured by TREK JAPAN). At the time of paper passing, character images of colors each having a print percentage of 1% were output on 5000 sheets of A4-size plain paper by performing a full-color print operation without turning on pre-exposure. At the time of each of the initiation of the evaluation and the completion of the passing of 5000 sheets, a solid white image was output on a first sheet. A print for evaluating a ghost (as illustrated in FIG. 3, solid square images were output on a white background (white image) at the leading end of the sheet, and then a one-dot, knight-jump pattern halftone image illustrated in FIG. 4 was formed. In FIG. 3, portions expressed as "ghost" are ghost portions to evaluate whether ghost images due to the solid images appear or not. If ghost images appear, the ghost images appear in the "ghost" in FIG. 3) was continuously output on five sheets. Next, a solid black image was output on one sheet, and then the print for evaluating a ghost was output on five sheets again.

Evaluation of Ghost Image

The ghost images were evaluated as described below. In the print for evaluating a ghost, differences in image density between the one-dot, knight-jump pattern halftone image and the ghost portions were measured with a spectral densitometer X-Rite 504/508 (manufactured by X-Rite) at ten points of one ghost image, and the average of the ten measured values was defined as a result for one sheet. All the ten ghost images were subjected to the same measurement, and the average of the measured values was determined. A smaller difference in image density between the halftone image and the ghost portions indicates better suppression of the formation of a ghost image. Table 7 shows the results.

Evaluation of Black-Spot Image

A black-spot image was evaluated as follows: A solid white image was output on glossy paper. Differences in image density between unprinted glossy paper and the glossy paper on which the solid white image had been formed were measured with a reflection densitometer (TC-6DS, manufactured by Tokyo Denshoku Co., Ltd). The differences in image density were measured at ten points, and the average of the values was determined. A smaller difference in image density between the unprinted glossy paper and the glossy paper on which the solid white image had been formed indicates a smaller number of black spots, which is satisfactory. Table 7 shows the results.

TABLE 7

| Evaluation result | | | |
|---|---|---|---|
| | | Difference in image density of ghost | Black spot |
| Example | 1 | 0.025 | 1.4 |
| | 2 | 0.025 | 1.5 |
| | 3 | 0.027 | 1.4 |
| | 4 | 0.035 | 1.2 |
| | 5 | 0.025 | 1.5 |
| | 6 | 0.026 | 1.5 |
| | 7 | 0.028 | 1.6 |
| | 8 | 0.025 | 1.5 |
| | 9 | 0.026 | 1.6 |
| | 10 | 0.027 | 1.7 |
| | 11 | 0.027 | 1.5 |
| | 12 | 0.028 | 1.4 |
| | 13 | 0.028 | 1.6 |
| | 14 | 0.027 | 1.5 |
| | 15 | 0.031 | 1.9 |
| | 16 | 0.034 | 1.8 |
| | 17 | 0.032 | 1.7 |
| | 18 | 0.020 | 2.2 |
| | 19 | 0.021 | 2.1 |
| | 20 | 0.022 | 2.2 |
| | 21 | 0.023 | 2.2 |
| | 22 | 0.022 | 2.1 |
| | 23 | 0.023 | 2.0 |
| | 24 | 0.024 | 2.0 |
| | 25 | 0.024 | 2.2 |
| | 26 | 0.024 | 2.1 |
| | 27 | 0.022 | 2.0 |
| | 28 | 0.024 | 2.0 |
| | 29 | 0.022 | 1.7 |
| | 30 | 0.024 | 1.8 |
| | 31 | 0.023 | 1.6 |
| | 32 | 0.022 | 2.3 |
| | 33 | 0.024 | 2.2 |
| Comparative Example | 1 | 0.072 | 1.1 |
| | 2 | 0.036 | 1.5 |
| | 3 | 0.038 | 1.6 |
| | 4 | 0.035 | 1.7 |
| | 5 | 0.035 | 1.5 |
| | 6 | 0.079 | 1.6 |
| | 7 | 0.024 | 2.5 |
| | 8 | 0.028 | 2.5 |
| | 9 | 0.029 | 3.1 |
| | 10 | 0.032 | 2.2 |
| | 11 | 0.034 | 2.2 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-242462 filed Oct. 28, 2010, which is hereby incorporated by reference herein in its entirety.

What is claimed is:

1. An electrophotographic photosensitive member comprising:

a conductive support;

an intermediate layer provided on the conductive support; and a photosensitive layer provided on the intermediate layer and comprising a charge-generating substance and a hole-transporting substance, wherein at least one of the intermediate layer and the photosensitive layer comprises a compound represented by the following formula (1):

(1)

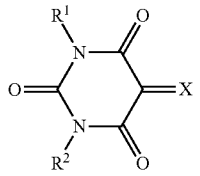

wherein, in the formula (1), $R^1$ and $R^2$ each independently represent a hydrogen atom or a methyl group, and X represents a group having a structure represented by the following formula (X1) or (X2):

(X1)

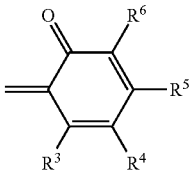

wherein, in the formula (X1), $R^3$ to $R^6$ each independently represent a hydrogen atom, an alkyl group having 1 to 4 carbon atoms, a halogen atom, a methoxy group, or an atomic group for forming an aromatic ring together with $R^n$ and $R^{n+1}$, n represents an integer from 3 to 5, and the aromatic ring is unsubstituted or substituted with a halogen atom, an alkyl group having 1 to 4 carbon atoms, a halogenated alkyl group having 1 to 4 carbon atoms, or a nitro group, (X2)

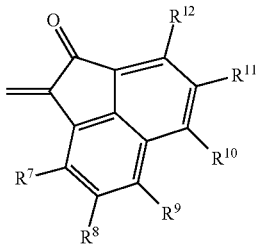

wherein, in the formula (X2), $R^7$ to $R^{12}$ each independently represent a hydrogen atom, an alkyl group having a 1 to 4 carbon atoms, a halogen atom, a methoxy group, a nitro group, a halogenated alkyl group having 1 to 4 carbon atoms, or an atomic group for forming an aromatic ring together with $R^n$ and $R^{n+1}$, and n represents an integer from 7 to 11.

2. The electrophotographic photosensitive member according to claim 1, wherein the compound represented by the formula (1) is a compound represented by the following formula (1-1):

(1-1)

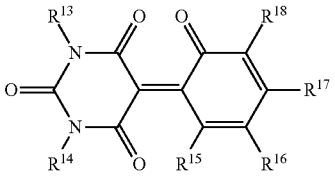

wherein, in the formula (1-1), $R^{13}$ and $R^{14}$ each independently represent a hydrogen atom or a methyl group, $R^{15}$ to $R^{18}$ each independently represent a hydrogen atom, an alkyl group having 1 to 4 carbon atoms, a halogen atom, a methoxy group, or an atomic group for forming an aromatic ring together with $R^n$ and $R^{n+1}$, n represents an integer from 15 to 17, and the aromatic ring is unsubstituted or substituted with a halogen atom, an alkyl group having 1 to 4 carbon atoms, a halogenated alkyl group having 1 to 4 carbon atoms, or a nitro group.

3. The electrophotographic photosensitive member according to claim 1, wherein the compound represented by the formula (1) is a compound represented by the following formula (1-2):

(1-2)

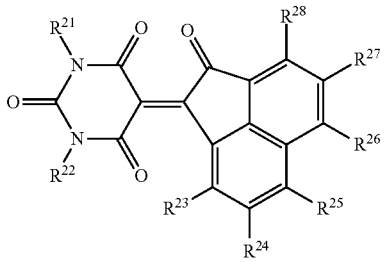

wherein, in the formula (1-2), $R^{21}$ and $R^{22}$ each independently represent a hydrogen atom or a methyl group, $R^{23}$ to $R^{28}$ each independently represent a hydrogen atom, an alkyl group having 1 to 4 carbon atoms, a halogen atom, a methoxy group, a nitro group, a halogenated alkyl group having 1 to 4 carbon atoms, or an atomic group for forming an aromatic ring together with $R^n$ and $R^{n+1}$, and n represents an integer from 23 to 27.

4. The electrophotographic photosensitive member according to claim 1, wherein the photosensitive layer comprises a charge-generating layer comprising the charge-generating substance, and a hole-transporting layer provided on the charge-generating layer and comprising the hole-transporting substance, wherein at least one of the intermediate layer and the charge-generating layer comprises the compound represented by the formula (1).

5. The electrophotographic photosensitive member according to claim 1, wherein the intermediate layer comprises metal oxide particles.

6. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transferring device, and a cleaning device.

7. An electrophotographic apparatus comprising:

the electrophotographic photosensitive member according to claim 1;

a charging device;

an exposure device;

a developing device; and a transferring device.

* * * * *